US007053559B2

(12) United States Patent
Kim et al.

(10) Patent No.: US 7,053,559 B2
(45) Date of Patent: May 30, 2006

(54) METHOD AND APPARATUS FOR DRIVING PLASMA DISPLAY PANEL

(75) Inventors: Won Tae Kim, Kumi-shi (KR); Soo Seok Sim, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 51 days.

(21) Appl. No.: 10/614,166

(22) Filed: Jul. 8, 2003

(65) Prior Publication Data

US 2004/0021653 A1 Feb. 5, 2004

(30) Foreign Application Priority Data

Jul. 16, 2002 (KR) ..... 10-2002-0041768

(51) Int. Cl.
*G09G 3/10* (2006.01)
*G09G 3/28* (2006.01)

(52) U.S. Cl. ..... 315/169.3; 315/169.1; 345/60; 345/55

(58) Field of Classification Search ..... 315/169.3, 315/169.1, 169.2, 169.4; 345/55, 60, 67, 345/68; 313/584, 585
See application file for complete search history.

(56) References Cited

U.S. PATENT DOCUMENTS 6,242,860 B1 * 6/2001 Sasao et al. ..... 313/586
6,384,802 B1 * 5/2002 Moon ..... 345/60
6,525,701 B1 * 2/2003 Kang ..... 345/60
6,608,609 B1 * 8/2003 Setoguchi et al. ..... 345/60
6,624,587 B1 * 9/2003 Kim ..... 315/169.1
2001/0017605 A1 8/2001 Hashimoto et al. ..... 345/60
2002/0135544 A1 * 9/2002 Myung ..... 345/60
2002/0186184 A1 * 12/2002 Lim ..... 345/60
2003/0122740 A1 * 7/2003 Lee et al. ..... 345/60
2003/0222835 A1 * 12/2003 Yoon et al. ..... 345/60

FOREIGN PATENT DOCUMENTS

| | | |
|---|---|---|
| EP | 0 813 222 A2 | 12/1997 |
| JP | H09-97570 | 4/1997 |
| JP | 10-064432 | 3/1998 |
| JP | 10-069858 | 3/1998 |

OTHER PUBLICATIONS

Copy of European Search Report.

* cited by examiner

*Primary Examiner*—Trinh Vo Dinh
(74) *Attorney, Agent, or Firm*—Fleshner & Kim, LLP

(57) ABSTRACT

A method and apparatus of driving a plasma display panel wherein an abnormal discharge generated from a non-display area can be prevented to thereby improve a picture quality. In the method and apparatus, at least partial ones of electrodes at the active area and at least partial ones of dummy electrodes positioned within the non-display area are driven with an identical signal.

16 Claims, 9 Drawing Sheets

METHOD AND APPARATUS FOR DRIVING PLASMA DISPLAY PANEL

BACKGROUND OF THE INVENTION

1. Field of the Invention

This invention relates to a plasma display panel, and more particularly to a method and apparatus of driving a plasma display panel wherein an abnormal discharge generated from a non-display area can be prevented to thereby improve a picture quality.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

Referring to FIG. 1, a discharge cell of a conventional three-electrode, AC surface-discharge PDP includes a sustain electrode pair having a scan electrode Y, a sustain electrode Z provided on an upper substrate 1, and an address electrode X provided on a lower substrate 2 in such a manner to perpendicularly cross the sustain electrode pair. Each of the scan electrode Y and the sustain electrode Z consists of a transparent electrode, and a metal bus electrode thereon. On the upper substrate 1 provided with the scan electrode Y and the sustain electrode, an upper dielectric layer 6 and a MgO protective layer 7 are disposed. A lower dielectric layer 4 is formed on the lower substrate 2 provided with the address electrode X in such a manner to cover the address electrode X. Barrier ribs 3 are vertically formed on the lower dielectric layer 4. A phosphorous material 5 is provided on the surfaces of the lower dielectric layer 4 and the barrier ribs 3. An inactive mixture gas such as He+Xe, Ne+Xe or He+Ne+Xe is injected into a discharge space among the upper substrate 1, the lower substrate 2 and the barrier ribs 3. The upper substrate 1 is joined with the lower substrate 2 with the aid of a sealant (not shown).

Such a PDP makes a time-divisional driving of one frame, which is divided into various sub-fields having a different emission frequency, so as to realize gray levels of a picture. Each sub-field is again divided into an initialization period (or reset period) for initializing the entire field, an address period for selecting the scan line and selecting the cell from the selected scan line and a sustain period for expressing gray levels depending on the discharge frequency. The initialization period is divided into a set-up interval supplied with a ramp-up waveform and a set-down interval supplied with a ramp-down waveform. For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-field SF1 to SF8 is divided into an initialization period, an address period and a sustain period as mentioned above. Herein, the initialization period and the address period of each sub-field are equal for each sub-field, whereas the sustain period and the number of sustain pulses assigned thereto are increased at a ratio of $2^n$ (wherein n=0, 1, 2, 3, 4, 5, 6 and 7) at each sub-field. FIG. 3 shows a driving waveform of the conventional PDP shown in FIG. 1.

Referring to FIG. 3, the PDP is divided into an initialization period for initializing the full field, an address period for selecting a cell, and a sustain period for sustaining a discharge of the selected cell for its driving.

In the initialization period, a ramp-up waveform Ramp-up is simultaneously applied all the scan electrodes Y in a set-up interval SU. A discharge is generated within the cells at the full field with the aid of the ramp-up waveform Ramp-up. By this set-up discharge, positive wall charges are accumulated onto the address electrode X and the sustain electrode Z while negative wall charges are accumulated onto the scan electrode Y. In a set-down interval SD, a ramp-down waveform Ramp-down falling from a positive voltage lower than a peak voltage of the ramp-up waveform Ramp-up is simultaneously applied to the scan electrodes Y after the ramp-up waveform Ramp-up was applied. The ramp-down waveform Ramp-down causes a weak erasing discharge within the cells to erase a portion of excessively formed wall charges. Wall charges enough to generate a stable address discharge are uniformly left within the cells with the aid of the set-down discharge.

In the address period, a negative scanning pulse scan is sequentially applied to the scan electrodes Y and, at the same time, a positive data pulse data is applied to the address electrodes X in synchronization with the scanning pulse scan. A voltage difference between the scanning pulse scan and the data pulse data is added to a wall voltage generated in the initialization period to thereby generate an address discharge within the cells supplied with the data pulse data. Wall charges enough to cause a discharge when a sustain voltage is applied are formed within the cells selected by the address discharge.

Meanwhile, a positive direct current voltage Zdc is applied to the sustain electrodes Z during the set-down interval and the address period. The direct current voltage Zdc establishes a voltage difference between the sustain electrode Z and the scan electrode Y or between the sustain electrode Z and the address electrode X such that a set-down discharge is generated between the sustain electrode Z and the scan electrode Y in the set-down interval and a discharge is not generated between the scan electrode Y and the sustain electrode Z in the address period.

In the sustain period, a sustaining pulse sus is alternately applied to scan electrodes Y and the sustain electrodes Z. Then, a wall voltage within the cell selected by the address discharge is added to the sustain pulse sus to thereby generate a sustain discharge, that is, a display discharge between the scan electrode Y and the sustain electrode Z whenever the sustain pulse sus is applied. Just after the sustain discharge was finished, a ramp waveform ramp-ers having a small pulse width and a low voltage level is applied to the sustain electrode Z to thereby erase wall charges left within the cells of the entire field.

Meanwhile, as shown in FIG. 4 and FIG. 5, the PDP includes a discharge space having the same structure as the discharge cell of the active area 31 at each of an upper non-display area 32 positioned at the upper outside of the active area 31 and a lower non-display area 33 positioned at the lower outside thereof. In other words, each of the upper non-display area 32 and the lower non-display area 33 is provided with an address electrode X and dummy electrodes UDE and BDE, and dielectric layers 4 and 6 are formed in such a manner to cover the electrodes X, UDE and BDE. The dummy electrodes UDE and BDE provided at each of the upper non-display area 32 and the lower non-display area 33 cause a discharge at the non-display area upon aging process, to thereby stabilize discharge characteristics of discharge cells on the first horizontal line and the nth horizontal line of the active area 31 at the same condition as other discharge cells at the active area 31. To this end, a voltage capable of causing a discharge upon aging process is applied to the dummy electrodes UDE and BDE while a voltage is not applied thereto after the aging process.

However, the conventional PDP has a problem in that a discharge is accidentally generated from the upper non-display area 32 and the lower non-display area 33. Such a discharge is referred to as "abnormal discharge". More specifically, if a discharge such as an initialization discharge, an address discharge and a sustain discharge, etc. occurs upon driving of the PDP, then space charges generated by the discharge are accumulated onto the upper non-display area 32 and the lower non-display area 33. For instance, upon address discharge, while a negative scan pulse scan being sequentially shifted into the scan electrodes Y1 to Yn as shown in FIG. 5, positive space charges 52 are moved into the lower non-display area 33 and, at the same time, negative space charges 51 are moved into the upper non-display area 32. The space charges 51 and 52 moved into the non-display areas 32 and 33 in this manner are accumulated within the non-display areas 32 and 33, or onto the dielectric layers 4 and 6 having covered electrodes at the active area adjacent to the non-display areas 32 and 33. If a wall charge 61 of the discharge space rising by wall charges accumulated on the non-display areas 32 and 33 and the active area 31 adjacent thereto becomes more than a voltage enough to cause a discharge as shown in FIG. 6, then an abnormal discharge accidentally occurs within the non-display areas 32 and 33 and the active area 31 adjacent thereto. Due to this abnormal discharge, a visible light 71 generated from the upper/lower edges of the non-display areas 32 and 33 and the active area 31 adjacent thereto is viewed by an observer as shown in FIG. 7. In the worse case, the PDP cannot display a picture during several seconds and its discharge cells may be damaged due to the abnormal discharge. Such an abnormal discharge becomes more serious as a brightness of the PDP becomes higher and a resolution thereof becomes higher.

In order to overcome such an abnormal discharge, Japanese Laid-open Patent Gazette No. Pyung 10-64432 has suggested a scheme of removing dielectric layers at the upper and lower edges of the PDP to discharge electric charges accumulated on the non-display area through the address electrode. Further, Japanese Laid-open Patent Gazette No. Pyung 10-69858 has disclosed a scheme of providing a normal turn-on area at the upper and lower edges of the PDP to cause a discharge at the normal turn-on area, thereby eliminating electric charges. However, such a scheme has a problem in that it is effective only when the entire area of the PDP is used as an effective display area, but it cannot prevent an abnormal discharge when only a portion of the PDP is used as an active area.

In addition, Japanese Laid-open Patent Gazette No. Pyung 10-64434 has suggested a scheme of mixing conductive particles within the dielectric layer provided with the address electrode and discharging electric charges accumulated on the upper and lower edges of the effective display area using the dielectric layer. However, such a scheme has a problem in that it is difficult to prevent a loss of an electric conductivity of the dielectric layer at the baking process.

SUMMARY OF THE INVENTION

Accordingly, it is an object of the present invention to provide a method and apparatus of driving a plasma display panel wherein an abnormal discharge generated from a non-display area can be prevented to thereby improve a picture quality.

In order to achieve these and other objects of the invention, in a method of driving a plasma display panel according to one aspect of the present invention having an active area for displaying a picture and a non-display area being adjacent thereto at the upper and lower sides of the active area, at least partial ones of electrodes at the active area and at least partial ones of dummy electrodes positioned within the non-display area are driven with an identical signal.

Herein, said at least partial ones of the dummy electrodes at the non-display area and sustain electrodes at the active area are supplied with a direct current voltage during at least partial period of an initialization period for initializing cells and an address period for selecting said cells.

An initializing waveform for initializing the entire cells is applied to at least partial ones of the dummy electrodes at the non-display area and the scan electrodes at the active area during the initialization period, and said direct current voltage is applied to at least partial ones of the dummy electrodes at the non-display area and the scan electrodes at the active area during the address period.

A driving apparatus for a plasma display panel according to another aspect of the present invention, having an active area for displaying a picture and a non-display area being adjacent thereto at the upper and lower sides of the active area, includes a driver for driving at least partial ones of electrodes at the active area and at least partial ones of dummy electrodes positioned within the non-display area with an identical signal.

In the driving apparatus, said driver includes a sustain driver for applying a direct current voltage to said at least partial ones of the dummy electrodes at the non-display area and sustain electrodes at the active area during at least partial period of an initialization period for initializing cells and an address period for selecting said cells.

Said driver further includes a scan driver for applying an initializing waveform for initializing the entire cells to at least partial ones of the dummy electrodes at the non-display area and the scan electrodes at the active area during the initialization period and for applying said direct current voltage to at least partial ones of the dummy electrodes at the non-display area and the scan electrodes at the active area during the address period.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 8:
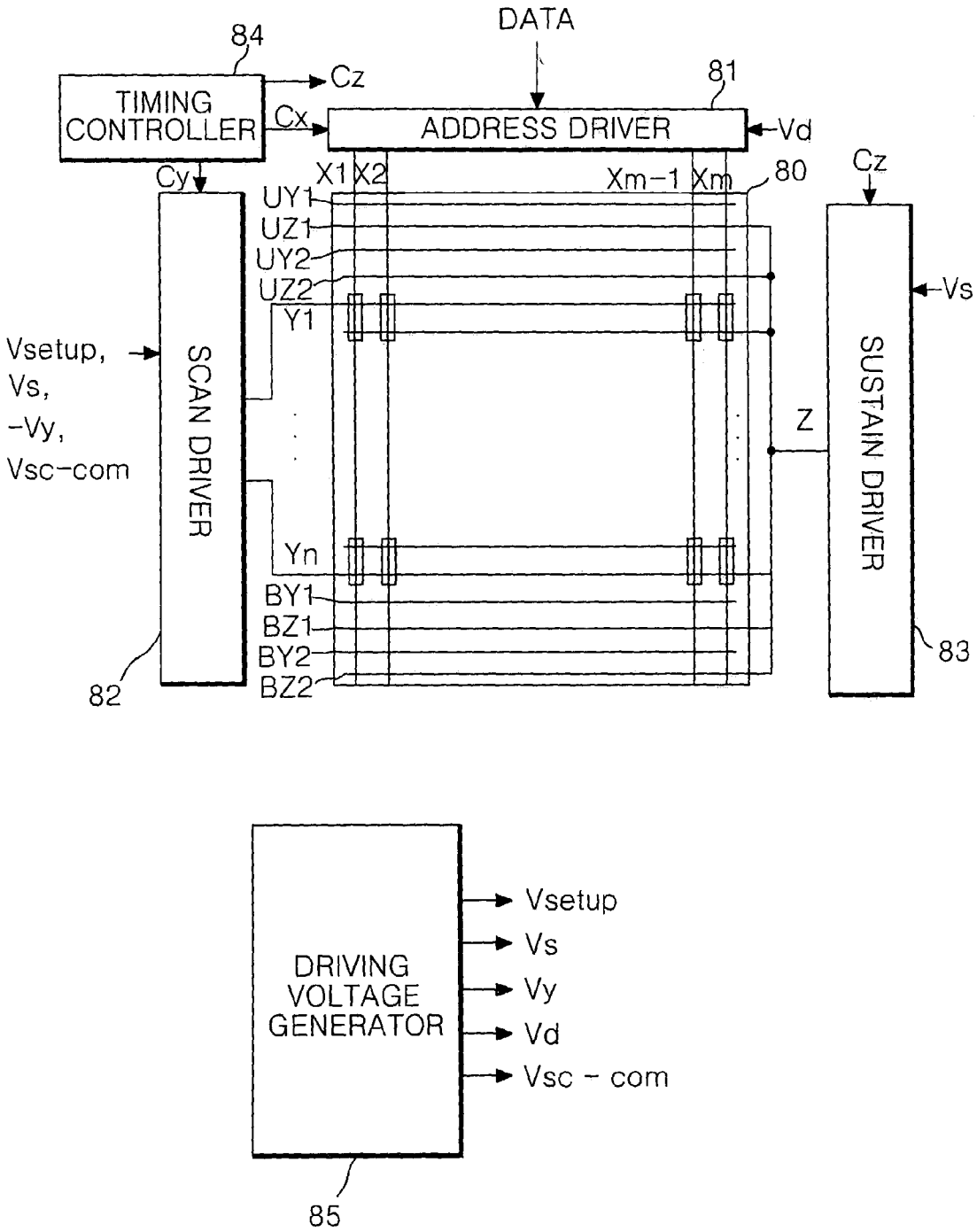
FIG. 8 is a schematic block diagram showing a configuration of a driving apparatus for a plasma display panel according to a first embodiment of the present invention.

FIG. 8 shows a driving apparatus for a plasma display panel (PDP) according to a first embodiment of the present invention.

Referring to FIG. 8, the driving apparatus includes a PDP 80 in which at least portions of upper dummy electrodes UY1 UZ1, UY2 and UZ2 and lower dummy electrodes BY1, BZ1, BY2 and BZ2 are connected to sustain electrodes Z of an active area for displaying a picture, an address driver 81 for supplying a data to address electrodes X1 to Xm of the PDP 80, a scan driver 82 for driving scan electrodes Y1 to Yn of the PDP 80, a sustain driver 83 for driving sustain electrodes Z of the PDP 80, a timing controller 84 for controlling each of electrode drivers 81 to 83, and a driving voltage generator 85 for generating driving voltages Vsetup, −Vy, Vs, Vd and Vsc-com.

The scan electrodes Y1 to Yn and the sustain electrodes Z are provided on the upper substrate of the PDP 80 within the active area. The dummy electrodes UY1, UZ1, UY2, UZ2, BY1, BZ1, BY2 and BZ2 are provided on the upper substrate of the PDP 80 within non-display areas positioned at the upper and lower sides of the active area. The address electrodes X1 to Xm are provided on the lower substrate of the PDP 80 in such a manner to cross the upper electrodes UY1, UZ1, UY2, UZ2, BY1, BZ1, BY2, BZ2, Y1 to Yn and Z. The dummy Z electrodes UZ1, UZ2, BZ1 and BZ2 corresponding to the even-numbered lines like the sustain electrodes Z of the active area 80, of the dummy electrodes UY1, UZ1, UY2, UZ2, BY1, BZ1, BY2 and BZ2, are connected to the sustain electrodes Z. Alternatively, all the dummy electrodes UY1, UZ1, UY2, UZ2, BY1, BZ1, BY2 and BZ2 may be connected to the sustain electrodes Z.

The address driver 81 is subject to a reverse gamma correction and an error diffusion by means of a reverse gamma correction circuit and an error diffusion circuit, etc. (not shown), and thereafter simultaneously supplies a data mapped for each sub-field by the sub-field mapping circuit to the address electrodes X1 to Xm under control of the timing controller 84.

The scan driver 82 simultaneously applies a ramp-up waveform rising until a set-up voltage Vsetup and a ramp-down waveform falling until 0V or a negative scan voltage −Vy during the reset period to the scan electrodes Y1 to Yn under control of the timing controller 84 to thereby initialize the entire field. Further, the scan driver 82 sequentially applies a scanning pulse falling from a scan common voltage Vsc-com until a negative scan voltage −Vy during the address period to the scan electrodes Y1 to Yn to select a scan line. The scan driver 82 simultaneously applies a sustaining pulse having a sustain voltage level Vs to the scan electrodes Y1 to Yn by a frequency corresponding to a brightness weighting value during the sustain period.

The sustain driver 83 applies a direct current (DC) voltage Zdc maintaining the sustain voltage Vs during the set-down interval SD of the initialization period and the address period to the sustain electrodes Z and the dummy Z electrodes UZ1, UZ2, BZ1 and BZ2 under control of the timing controller 84. Further, during the sustain period, the sustain driver 83 is operated alternatively with the scan driver 82 to apply a sustaining pulse to the sustain electrodes Z and the dummy Z electrodes UZ1, UZ2, BZ1 and BZ2.

The timing controller 84 receives a vertical/horizontal synchronizing signal to generate timing control signals Cx, Cy and Cz required for each electrode driver, and applies the timing control signals Cx, Cy and Cz to the corresponding drivers 81 to 83.

The driving voltage generator 85 generates voltages required for an electrode driving of the PDP 80, such as a set-up voltage Vsetup, a sustain voltage Vs, a negative scan voltage −Vy, a data voltage Vd and a scan common voltage Vsc-com, etc., and applies the driving voltages to the corresponding electrode drivers 81 to 83. The driving voltage generated from each electrode driver 81 to 83 is substantially identical to those in FIG. 3.

Figure 1:
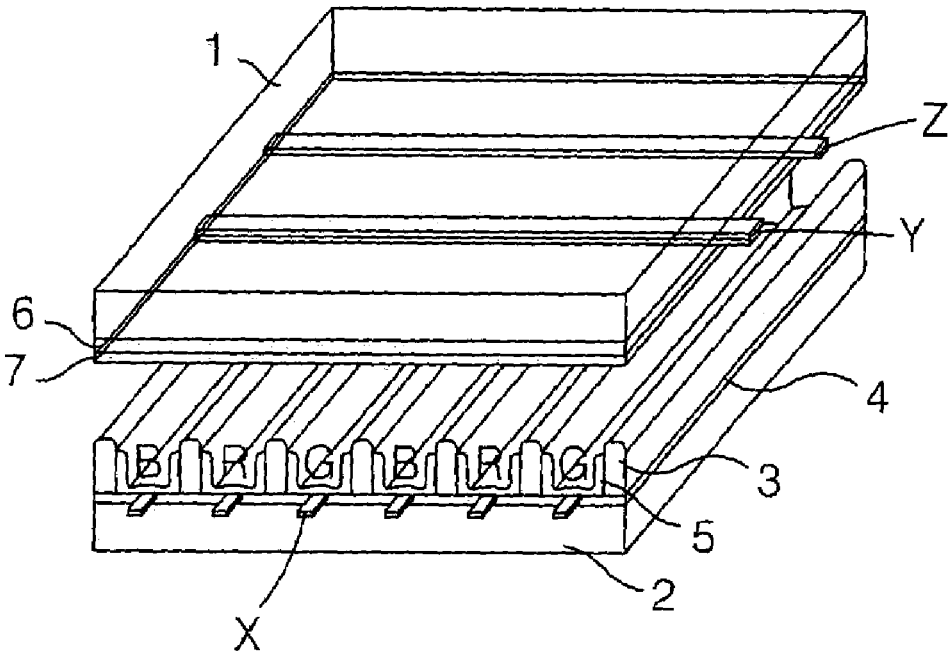
FIG. 1 RELATED ART
FIG. 1 is a perspective view showing a discharge cell structure of a conventional three-electrode, AC surface-discharge plasma display panel.
Figure 2:
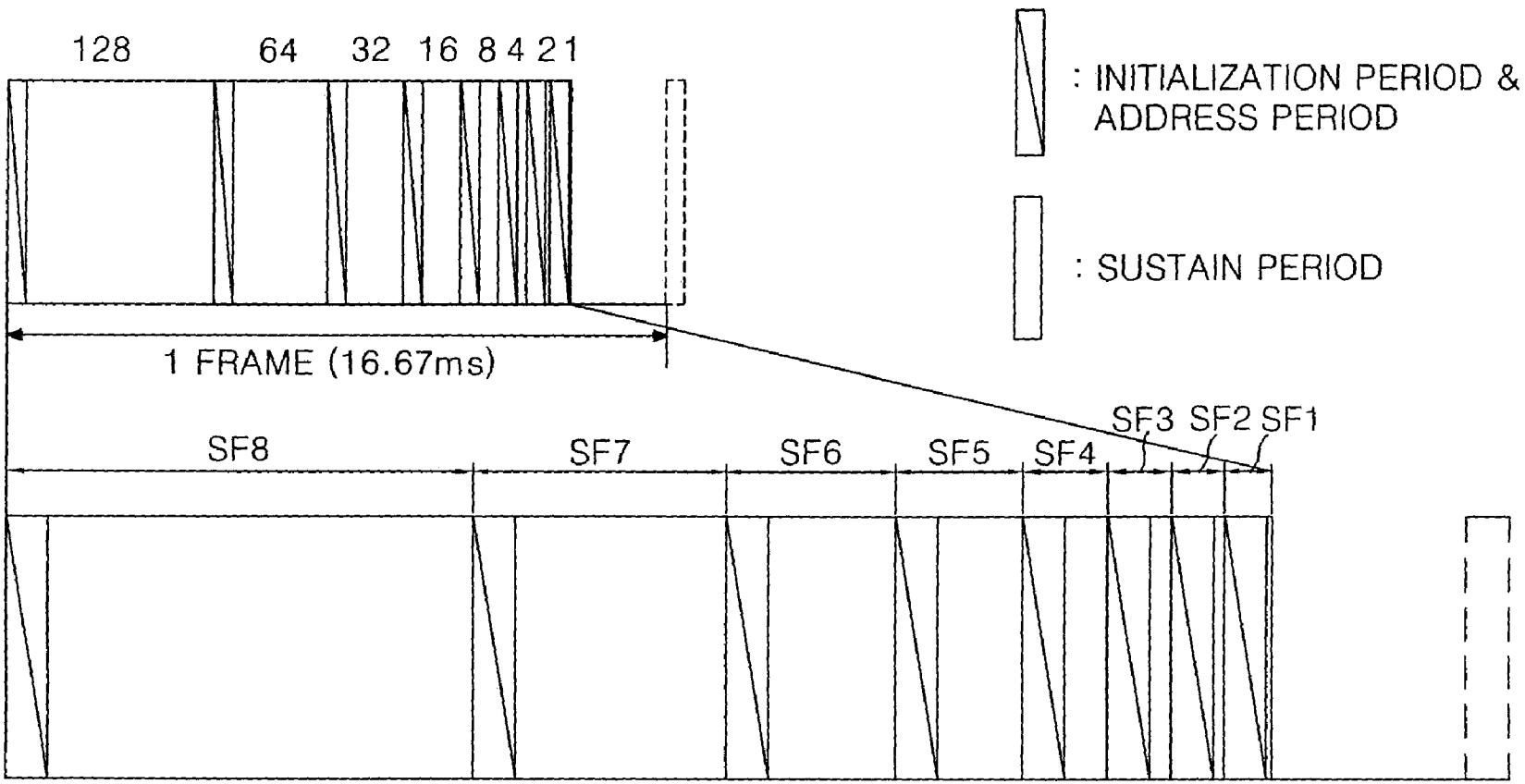
FIG.2 RELATED ART
FIG. 2 illustrates a frame configuration having 8-bit default codes for implementing 256 gray levels.
Figure 3:
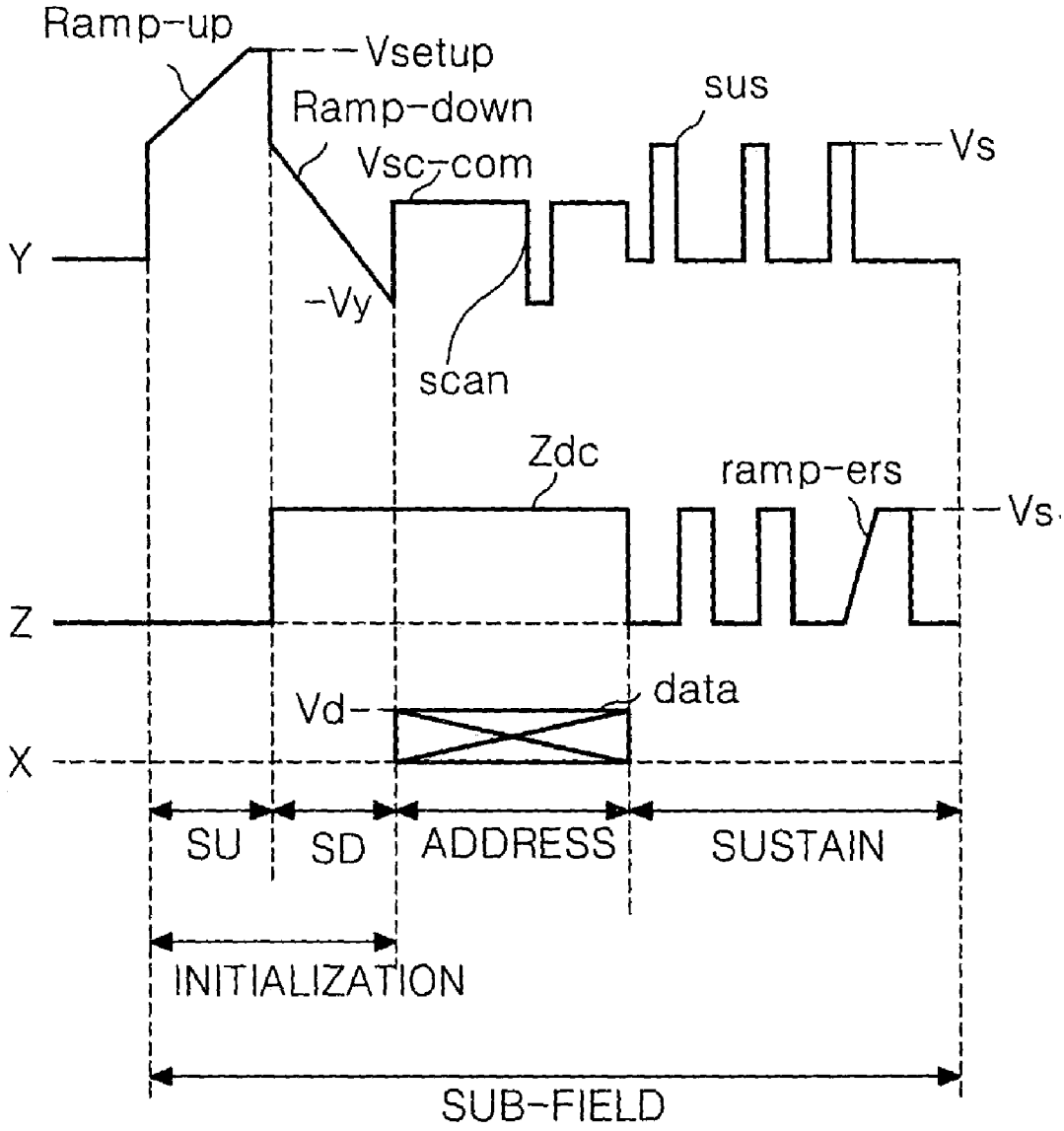
FIG. 3 RELATED ART
FIG. 3 is a waveform diagram of driving signals for driving the conventional plasma display panel.
Figure 4:
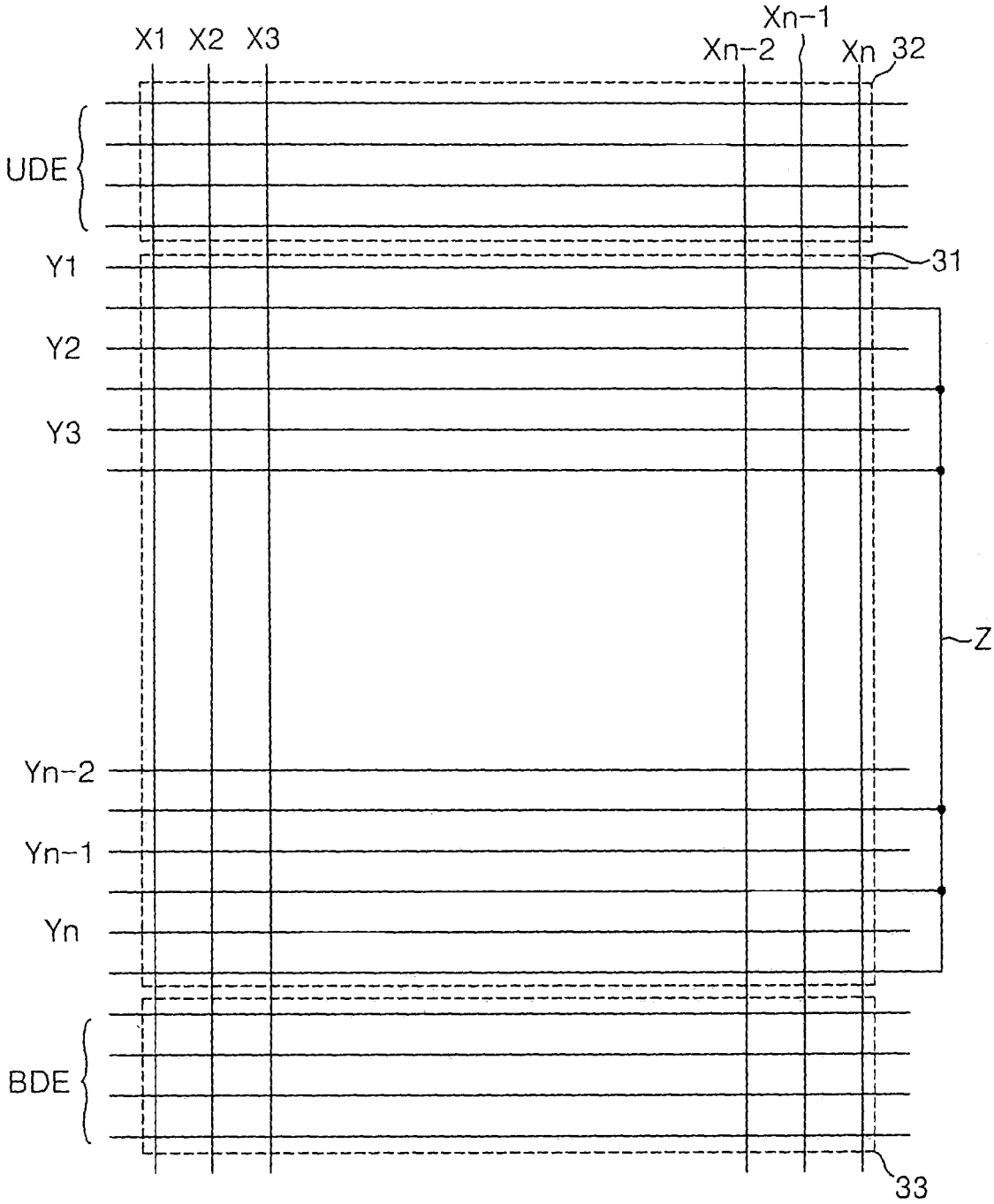
FIG. 4 RELATED ART
FIG. 4 is a plan view of the plasma display panel for representing a non-display area.
Figure 5:
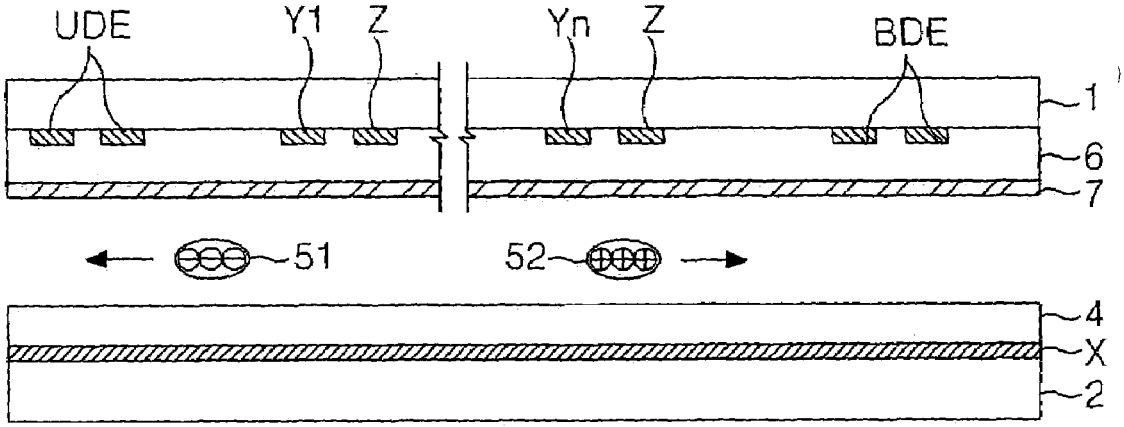
FIG. 5 RELATED ART
FIG. 5 is a section view of the plasma display panel for representing a non-display area.
Figure 6:
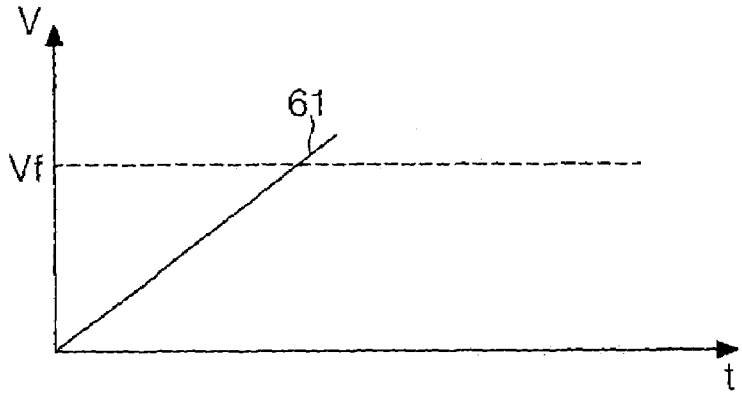
FIG. 6 RELATED ART
FIG. 6 is a graph representing a wall charge rising continuously at the non-display area.
Figure 7:
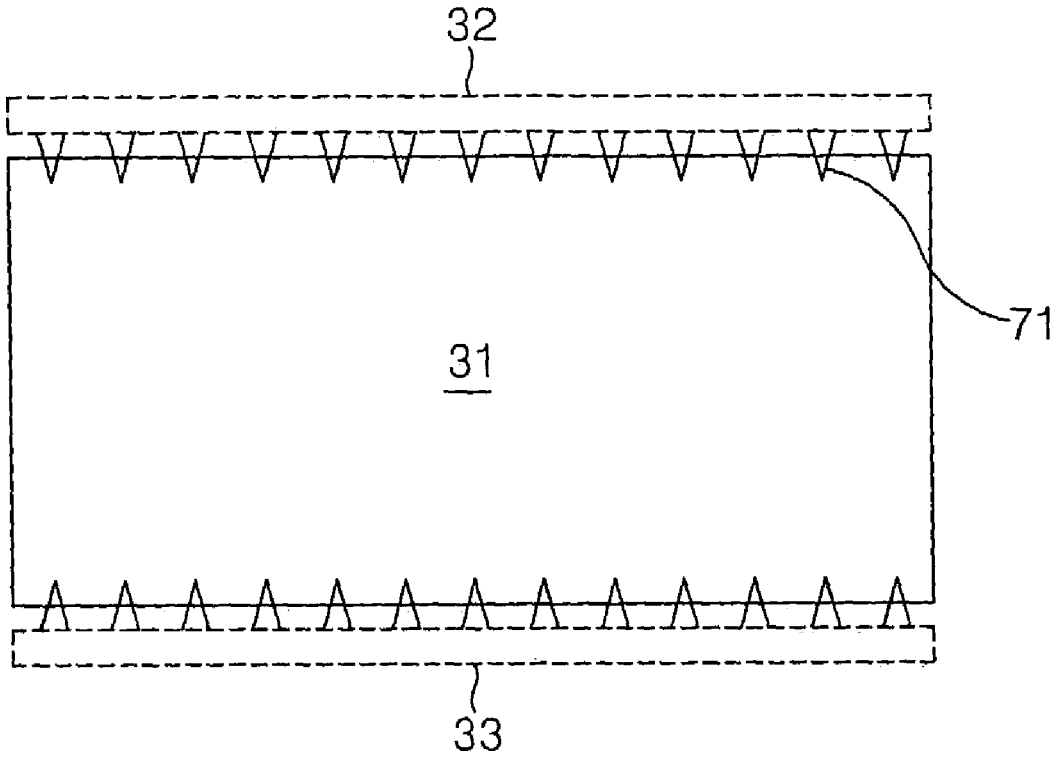
FIG. 7 RELATED ART
FIG. 7 schematically depicts a visible light generated from the non-display area and recognized at the active area.

An operation for restraining an abnormal discharge in the PDP according to the first embodiment of the present invention will be described in conjunction with FIG. 3 below.

The scan driver 82 applies a ramp-up waveform Ramp-up to all the scan electrodes Y in the set-up interval SU of the initialization period, and thereafter applies a ramp-down waveform falling from a positive voltage lower than a peak voltage of the rising ramp waveform Ramp-up to the scan electrodes Y in the set-down interval SD of the initialization period. Further, the scan driver 82 sequentially applies a scanning pulse falling until 0V or a negative scan voltage −Vy to the scan electrodes Y1 to Yn in the address period. During the set-down interval SD of the initialization period and the address period, the sustain driver 83 applies a positive DC voltage Zdc to the sustain electrodes Z and the dummy Z electrodes UZ1, UZ2, BZ1 and BZ2. With the aid of the sustain driver 83, the dummy Z electrodes UZ1, UZ2, BZ1 and BZ2 maintain a positive voltage during the set-down interval SD of the initialization period and the address period. As a result, negative space charges within the non-display area are restrained on the dummy Z electrodes UZ1, UZ2, BZ1 and BZ2 supplied with a positive voltage and negative wall charges accumulated on the address electrodes X1 to Xm are reduced during the set-down interval SD and the address period, so that a discharge is not generated at the non-display area or the active area adjacent thereto.

Figure 9:
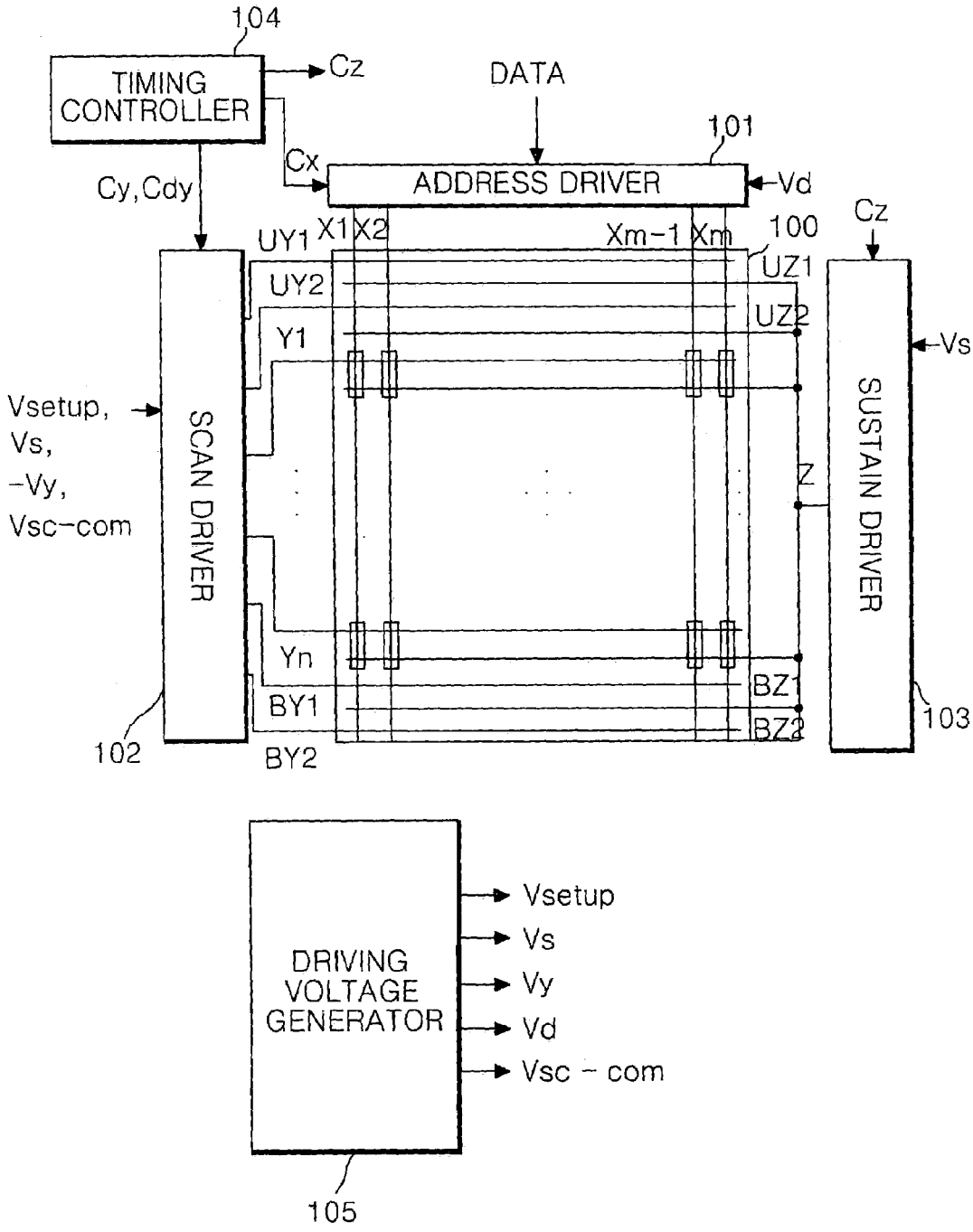
FIG. 9 is a schematic block diagram showing a configuration of a driving apparatus for a plasma display panel according to a second embodiment of the present invention.

FIG. 9 shows a driving apparatus for a plasma display panel (PDP) according to a second embodiment of the present invention.

Referring to FIG. 9, the driving apparatus includes a PDP 100 in which dummy electrodes UY1 UZ1, UY2 and UZ2 and lower dummy electrodes BY1, BZ1, BY2 and BZ2 are connected to sustain electrodes Z of an active area, an address driver 101 for supplying a data to address electrodes X1 to Xm of the PDP 100, a scan driver 102 for driving scan electrodes Y1 to Yn of the PDP 100 and dummy Y electrodes UY1, UY2, BY1 and BY2, a sustain driver 103 for driving sustain electrodes Z of the PDP 100, a timing controller 104 for controlling each of electrode drivers 101 to 103, and a driving voltage generator 105 for generating driving voltages Vsetup, −Vy, Vs, Vd and Vsc-com.

The scan electrodes Y1 to Yn and the sustain electrodes Z are provided on the upper substrate of the PDP 100 within the active area. The dummy electrodes UY1, UZ1, UY2, UZ2, BY1, BZ1, BY2 and BZ2 are provided on the upper substrate of the PDP 100 within non-display areas positioned at the upper and lower sides of the active area. The address electrodes X1 to Xm are provided on the lower substrate of the PDP 100 in such a manner to cross the upper electrodes UY1, UZ1, UY2, UZ2, BY1, BZ1, BY2, BZ2, Y1 to Yn and Z. The dummy Z electrodes UZ1, UZ2, BZ1 and BZ2 corresponding to the even-numbered lines like the sustain electrodes Z of the active area 100, of the dummy electrodes UY1, UZ1, UY2, UZ2, BY1, BZ1, BY2 and BZ2, are connected to the sustain electrodes Z to be driven by the sustain driver 103. The dummy Y electrodes UY1, UY2, BY1 and BY2 corresponding to the odd-numbered lines like the scan electrodes Y1 to Yn of the active area 100, of the dummy electrodes UY1, UZ1, UY2, UZ2, BY1, BZ1, BY2 and BZ2, are driven by the scan driver 102.

The address driver 101 is subject to a reverse gamma correction and an error diffusion by means of a reverse gamma correction circuit and an error diffusion circuit, etc. (not shown), and thereafter simultaneously supplies a data mapped for each sub-field by the sub-field mapping circuit to the address electrodes X1 to Xm under control of the timing controller 104.

The scan driver 102 simultaneously applies a ramp-up waveform rising until a set-up voltage Vsetup and a ramp-down waveform falling until 0V or a negative scan voltage −Vy during the reset period to the scan electrodes Y1 to Yn under control of the timing controller 104 to thereby initialize the entire field. Further, the scan driver 102 sequentially applies a scanning pulse falling from a scan common voltage Vsc-com until a negative scan voltage −Vy during the address period to the scan electrodes Y1 to Yn to select a scan line, and apples 0V or a specified positive voltage level, for example, a direct current bias voltage maintaining the scan common voltage Vsc-com to the dummy Y electrodes UY1, UY2, BY1 and BY2 during the address period to bind negative wall charges onto the dummy Y electrodes UY1, UY2, BY1 and BY2, thereby restraining an abnormal discharge from being generated between the active area and the non-display area. The scan driver 102 simultaneously applies a sustaining pulse having a sustain voltage level Vs to the scan electrodes Y1 to Yn by a frequency corresponding to a brightness weighting value during the sustain period following the address period.

The sustain driver 103 applies a direct current (DC) voltage Zdc maintaining the sustain voltage Vs during the set-down interval SD of the initialization period and the address period to the sustain electrodes Z and the dummy Z electrodes UZ1, UZ2, BZ1 and BZ2 under control of the timing controller 104. Further, during the sustain period, the sustain driver 103 is operated alternatively with the scan driver 102 to apply a sustaining pulse to the sustain electrodes Z and the dummy Z electrodes UZ1, UZ2, BZ1 and BZ2.

The timing controller 104 receives a vertical/horizontal synchronizing signal to generate timing control signals Cx, Cy and Cz required for each electrode driver 101 to 103, and applies the timing control signals Cx, Cy and Cz to the corresponding drivers 101 to 103. Herein, the scan driver 102 is supplied with a timing control signal for controlling voltages applied to the scan electrodes Y1 to Yn of the active area along with a timing control signal Cdy for controlling voltages at the dummy Y electrodes UY1, UY2, BY1 and BY2 of the non-display area.

The driving voltage generator 105 generates voltages required for an electrode driving of the PDP 100, such as a set-up voltage Vsetup, a sustain voltage Vs, a negative scan voltage −Vy, a data voltage Vd and a scan common voltage Vsc-com, etc., and applies the driving voltages to the corresponding electrode drivers 101 to 103.

Figure 10:
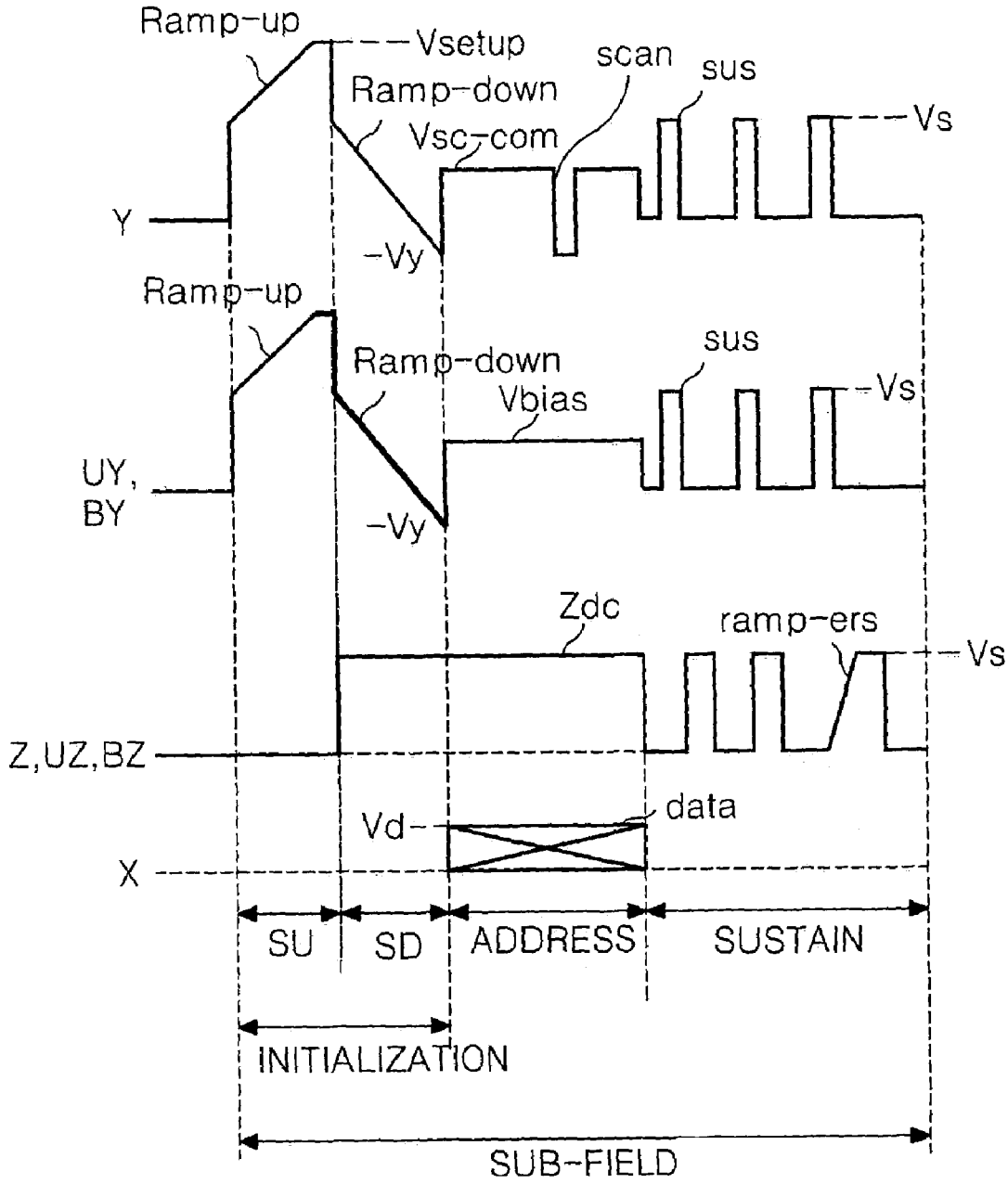
FIG. 10 is a waveform diagram of a waveform applied to each electrode of the plasma display panel shown in FIG. 9.

FIG. 10 shows a driving waveform for the PDP shown in FIG. 9.

Referring to FIG. 10, a ramp-up waveform Ramp-up is simultaneously applied to all the scan electrodes Y and the dummy Y electrodes UY1, UY2, BY1 and BY2 in the set-up interval SU of the initialization period. A discharge is generated within the cells of the entire field by this ramp-up waveform Ramp-up. After the ramp-up waveform Ramp-up was applied, a ramp-down waveform falling from a positive voltage lower than a peak voltage of the rising ramp waveform Ramp-up is simultaneously applied to the scan electrodes Y and the dummy Y electrodes UY1, UY2, BY1 and BY2 in the set-down interval SD of the initialization period. At this time, a majority of excessive wall charges left within the non-display area are erased by an initializing waveform applied to the dummy Y electrodes UY1, UY2, BY1 and BY2, and such a state is maintained until termination of the address period by a DC bias voltage applied in the address period. On the other hand, the scan electrodes Y1 to Yn of the active area rise until a positive scan common voltage Vsc-com upon initiation of the address period. Since voltages on the scan electrodes Y1 and Yn rise until the scan common voltage Vsc-com in this manner, the cells at the active area establish an address initialization condition in which wall charges enough to cause an address discharge are accumulated when a scanning pulse and a data pulse are applied at an address initiation time.

In the address period, a negative scanning pulse scan is sequentially applied to the scan electrodes Y and, at the same time, a positive data pulse data is applied to the address electrodes X in synchronization with the scanning pulse scan. While a voltage difference between the scanning pulse scan and the data pulse data being added to a wall voltage generated in the initialization period, an address discharge is generated within the cell supplied with the data pulse data. Within the cells selected by the address discharge, wall charges enough to cause a discharge upon application of the sustain voltage are formed. During such an address period, a DC bias voltage Vbias maintaining 0V or a positive voltage level is applied to the dummy Y electrodes UY1, UY2, BY1 and BY2. The DC bias voltage Vbias applied to the dummy Y electrodes UY1, UY2, BY1 and BY2 binds negative space charges and negative wall charges within the non-display area onto the dummy Y electrodes UY1, UY2, BY1 and BY2.

The dummy Z electrodes UZ1, UZ2, BZ1 and BZ2 and the sustain electrodes Z maintains a positive voltage during the set-down interval SD of the initialization period and the address period. The positive DC voltage applied to the dummy Z electrodes UZ1, UZ2, BZ1 and BZ2 bind negative space charges and negative wall charges within the non-display area onto the dummy Z electrodes UZ1, UZ2, BZ1 and BZ2 during the set-down interval and the address period. The DC voltage Zdc to the sustain electrodes Z establishes a voltage difference between the sustain electrode Z and the scan electrode Y or between the sustain electrode Z and the address electrode X such that a set-down discharge is caused between the sustain electrodes Z and the scan electrodes Y1 to Yn in the set-down interval and a discharge is not caused largely between the scan electrodes Y1 to Yn and the sustain electrode Z in the address period.

In the sustain period, a sustaining pulse sus is alternately applied to the scan electrodes Y1 to Yn and the sustain electrodes Z. At this time, the dummy Y electrodes UY1, UY2, BY1 and BY2 are supplied with a sustain voltage in similarity to the scan electrodes Y1 to Yn while the dummy Z electrodes UZ1, UZ2, BZ1 and BZ2 are supplied with a sustain voltage in similarity to the sustain electrodes Z, but an abnormal discharge is not generated within the non-display area even upon application of the sustain voltage because a wall voltage within the non-display area is very low. Within the active area, the cell selected by the address discharge causes a sustain discharge, that is, a display discharge whenever the sustain pulse sus is applied while a wall voltage within the cell being added to the sustaining pulse sus.

Just after the sustain discharge was finished, an erasing tramp waveform ramp-ers is applied to the sustain electrodes Z and the dummy Z electrodes UZ1, UZ2, BZ1 and BZ2. With the aid of the erasing ramp waveform ramp-ers, wall charges left within the active area and the non-display area are erased.

As described above, according to the present invention, a voltage supplied to the sustain electrode within the active area is applied to the dummy electrodes within the non-display area, or a voltage supplied to the sustain electrode within the active area is applied to the dummy electrodes within the non-display area, and a voltage supplied to the scan electrode within the active area is applied to the dummy electrodes within the non-display area. Accordingly, according to the present invention, wall charges within the non-display area can be reduced, and a movement of the wall charges is restrained to prevent an abnormal discharge within the non-display area or between the non-display area and the active area, thereby improving a picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel having an active area for displaying a picture and a non-display area being adjacent thereto at the upper and lower sides of the active area, wherein initialization signals are applied to at least one of scan electrodes at the active area and at least two dummy electrodes positioned within the non-display area during an initialization period of at least one sub-field and the initialization signal of the at least two dummy electrodes and the initialization signal of the at least one scan electrode are similar in shape, and signals of the at least one other dummy electrode at the non-display area and at least one of sustain electrodes at the active area are similar in shape during the initialization period and during an address period, wherein each of the initialization signal applied to the at least one of scan electrodes and the initialization signal applied to the at least two dummy electrodes includes at least one of ramp-up signal or a ramp-down signal.

2. The method as claimed in claim 1, wherein direct current voltages are applied to the at least two of the dummy electrodes at the non-display area and the at least one of the scan electrodes at the active area during at least a partial period of the address period of the at least one sub-field, and a scan signal is further provided to the at least one of the scan electrodes at the active area during at least a partial period the address period of the at least one sub-field.

3. The method as claimed in claim 2, wherein said direct current voltages are similar voltages.

4. The method as claimed in claim 1, wherein at least one of the sustain electrodes and at least one other dummy electrode receive similar direct current voltages different from a zero voltage during at least a partial period of the initialization period and during at least a partial period of an address period.

5. The method of claim 1, wherein one of the at least two dummy electrodes is provided in an upper non-display area and the other is provided in a lower non-display area.

6. A method of driving a plasma display panel having an active area for displaying a picture and a non-display area being adjacent thereto at the upper and lower sides of the active area, wherein initialization signals are applied to at least one of scan electrodes at the active area and at least two dummy electrodes positioned within the non-display area during an initialization period of at least one sub-field, and the initialization signal of the at least two dummy electrodes and the initialization signal of the at least one scan electrode are similar in shape, wherein said at least one other dummy electrode at the non-display area and at least one of sustain electrodes at the active area are supplied with a direct current voltage having a voltage different from a zero voltage during at least a partial period of the initialization period and during at least a partial period of an address period, and each of the initialization signal applied to the at least one of scan electrodes and the initialization signal applied to the at least two dummy electrodes includes at least one of a ramp-up signal or a ramp-down signal.

7. The method as claimed in claim 6, wherein signals of at least one other dummy electrode at the non-display area and at least one of sustain electrodes at the active area are similar during the initialization period and during the address period.

8. The method of claim 6, wherein the direct current voltage is provided near an end of the initialization period, and continues into the at least the partial period of the address period, and the direct current voltage provided near the end of the initialization period and the direct current voltage provided to the at least the partial period of the address period are similar.

9. A driving apparatus for a plasma display panel having an active area for displaying a picture and a non-display area being adjacent thereto at upper and lower sides of the active area, said apparatus comprising:

a driver for driving at least one of electrodes at the active area and at least two dummy electrodes positioned within the non-display area, said driver including a scan driver to apply initialization signals to the at least two dummy electrodes positioned within the non-display area and the at least one scan electrode at the active area during an initialization period of the at least one sub-field, wherein the initialization signal of the at least two dummy electrodes and the initialization signal of the at least one scan electrode are similar in shape, and a sustain driver for applying signals of similar shape to said at least one other dummy electrode at the non-display area and at least one of sustain electrodes at the active area during the initialization period and during an address period, wherein each of the initialization signal applied to the at least one of scan electrodes and the initialization signal applied to the at least two dummy electrodes includes at least one of a ramp-up signal or a ramp-down signal.

10. The driving apparatus as claimed in claim 9, wherein said sustain driver is configured to apply direct current voltages different from a zero voltage to said at least one other dummy electrode at the non-display area and at least one of sustain electrodes at the active area during at least a partial period of the initialization period and during at least a partial period of the address period of the at least one sub-field.

11. The driving apparatus as claimed in claim 9, wherein the scan driver further applies direct current voltages to the at least two dummy electrodes at the non-display area and the at least one of the scan electrodes at the active area during at least a partial period of the address period of the at least one sub-field, and a scan signal is further provided to the at least one of the scan electrodes at the active area during at least a partial period of the address period of the at least one sub-field.

12. The driving apparatus of claim 9, wherein one of the at least two dummy electrodes is provided in an upper non-display area and the other is provided in a lower non-display area.

13. A plasma display driving method comprising:

applying first signals to scan electrodes of a plasma display panel;

applying second signals to first dummy electrodes of the plasma display panel, the second signals being substantially identical to the first signals, wherein each of the first signals is provided to a corresponding scan electrode, and each of the second signals is provided to a corresponding first dummy electrode, and a waveform of the first signal and a waveform of the second signal provided during an initialization period are substantially the same;

applying third signals to sustain electrodes of the plasma display panel; and applying fourth signals to second dummy electrodes, wherein the third signals are substantially identical to the fourth signals during an initialization period and during an address period, each of the waveform of the first signal and the waveform of the second signal provided during the initialization period includes at least one of a ramp-up waveform or a ramp-down waveform.

14. The plasma display driving method of claim 13, wherein a waveform of the first signal and a waveform of the second signal provided during the address period are substantially the same except for a scan waveform being provided within the waveform of the first signal, and wherein a waveform of the first signal and a waveform of the second signal provided during a sustain period are substantially the same.

15. The plasma display driving method of claim 13, wherein the third signals applied to the sustain electrodes and the fourth signals applied to the second dummy electrodes include a direct current voltage different from a zero voltage, which is applied during at least a partial period of the initialization period and at least a partial period of the address period.

16. The method as claimed in claim 15, wherein direct current voltages are similar.

* * * * *